US009011004B2

(12) United States Patent
Paulin

(10) Patent No.: US 9,011,004 B2
(45) Date of Patent: Apr. 21, 2015

(54) FLEXIBLE STORAGE BAG

(76) Inventor: Kathy Wood Paulin, San Diego, CA (US)

( * ) Notice: Subject to any disclaimer, the term of this patent is extended or adjusted under 35 U.S.C. 154(b) by 421 days.

(21) Appl. No.: 13/307,898

(22) Filed: Nov. 30, 2011

(65) Prior Publication Data

US 2012/0141049 A1 Jun. 7, 2012

Related U.S. Application Data

(60) Provisional application No. 61/419,103, filed on Dec. 2, 2010.

(51) Int. Cl.

| | |
|---|---|
| ***B65D 33/16*** | (2006.01) |
| ***B65D 30/22*** | (2006.01) |
| ***B65D 33/00*** | (2006.01) |
| ***B65D 33/14*** | (2006.01) |
| ***B65D 33/25*** | (2006.01) |

(52) U.S. Cl.

CPC ..... *B65D 31/12* (2013.01); *B65D 33/007* (2013.01); *B65D 33/14* (2013.01); *B65D 33/2566* (2013.01); *B65D 33/2591* (2013.01); *B65D 2203/00* (2013.01)

(58) Field of Classification Search

USPC ..... 383/64, 61.3, 97, 63, 65, 42, 5, 105, 38, 383/106, 40, 39; 206/810

See application file for complete search history.

(56) References Cited

U.S. PATENT DOCUMENTS

| | | | | |
|---|---|---|---|---|
| 1,745,946 A | | 2/1930 | Murray | |
| 2,401,110 A | | 5/1946 | Rohdin | |
| 2,514,750 A | * | 7/1950 | Dobbs et al. | 383/64 |
| 2,714,557 A | | 8/1955 | Mahaffy | |
| 2,916,197 A | | 12/1959 | Detrie et al. | |
| 3,074,451 A | | 1/1963 | Whitney | |
| 3,469,768 A | | 9/1969 | Repko | |
| 4,201,031 A | | 5/1980 | Wiles | |
| 4,401,213 A | | 8/1983 | Lerner | |
| 4,479,244 A | | 10/1984 | Ausnit | |
| 4,993,844 A | | 2/1991 | Robinson et al. | |
| 5,259,904 A | | 11/1993 | Ausnit | |
| 5,358,407 A | | 10/1994 | Lainer | |
| 5,368,485 A | * | 11/1994 | Phillips | 434/75 |
| 5,373,966 A | * | 12/1994 | O'Reilly et al. | 222/94 |
| 5,554,093 A | | 9/1996 | Porchia et al. | |

(Continued)

FOREIGN PATENT DOCUMENTS

| | | |
|---|---|---|
| JP | 5319473 | 12/1993 |
| JP | 2001010298 | 1/2001 |

*Primary Examiner* — Jes F Pascua
*Assistant Examiner* — Matthew Theis
(74) *Attorney, Agent, or Firm* — Diederiks & Whitelaw, PLC

(57) ABSTRACT

A flexible storage bag defines an inner storage area within which is provided a flexible barrier. A user can select a first storage mode wherein the flexible barrier is positioned to one side such that only a single storage zone is available for storing products; or a dual storage mode wherein the barrier divides the storage area into first and second storage zones. The bag preferably includes an upper closure assembly having a loop extending therefrom to aid a user in sealing the bag, as well as potentially hanging the bag from a hook. The bag optionally includes a lower closure assembly on the flexible barrier for selectively sealing one of the multiple storage zones. Offset tabs may be provided to aid a user in opening the bag. In some embodiments, the bag includes a graphical image puzzle constituting multiple graphic images that combine to form a completed image.

5 Claims, 7 Drawing Sheets

(56) References Cited

U.S. PATENT DOCUMENTS

| | | | | |
|---|---|---|---|---|
| 5,618,111 | A | 4/1997 | Porchia et al. | |
| 5,683,340 | A | 11/1997 | Belias et al. | |
| 5,790,718 | A | 8/1998 | Tenner et al. | |
| 6,234,675 | B1 | 5/2001 | Saad et al. | |
| 6,575,627 | B2 * | 6/2003 | Huseman et al. | 383/38 |
| 6,579,008 | B2 * | 6/2003 | Price et al. | 383/38 |
| 6,786,638 | B1 | 9/2004 | Bonds et al. | |
| 6,874,938 | B2 * | 4/2005 | Price et al. | 383/109 |
| 7,040,808 | B2 * | 5/2006 | Rehwinkel et al. | 383/61.2 |
| D563,241 | S | 3/2008 | Nimey | |
| 7,370,689 | B2 | 5/2008 | Wang | |
| 7,510,328 | B2 * | 3/2009 | Schneider et al. | 383/204 |
| 7,556,429 | B2 | 7/2009 | Taheri | |
| 8,025,442 | B2 | 9/2011 | Paulin | |
| 2002/0020648 | A1 | 2/2002 | Lam et al. | |
| 2004/0066984 | A1 | 4/2004 | Yi Li | |
| 2004/0066986 | A1 | 4/2004 | Erlick et al. | |
| 2004/0179754 | A1 | 9/2004 | Taheri | |
| 2005/0061707 | A1 | 3/2005 | Naelitz-Thomas | |
| 2005/0111764 | A1 | 5/2005 | Solder | |
| 2006/0023974 | A1 | 2/2006 | Zimmerman | |
| 2006/0027478 | A1 | 2/2006 | Kaufman et al. | |
| 2006/0188180 | A1 | 8/2006 | Otsubo | |
| 2007/0104396 | A1 * | 5/2007 | Paulin | 383/106 |
| 2007/0237862 | A1 | 10/2007 | Pinkston | |
| 2008/0105679 | A1 * | 5/2008 | Ballard | 220/260 |
| 2008/0149235 | A1 * | 6/2008 | Jay | 150/143 |
| 2008/0226207 | A1 * | 9/2008 | Frayne | 383/109 |
| 2009/0142006 | A1 | 6/2009 | Wine et al. | |
| 2009/0208147 | A1 | 8/2009 | Steele | |
| 2010/0159096 | A1 | 6/2010 | Sam | |

* cited by examiner

FLEXIBLE STORAGE BAG

CROSS-REFERENCE TO RELATED APPLICATIONS

This application claims the benefit of U.S. Provisional Patent Application Ser. No. 61/419,103, filed Dec. 2, 2010.

BACKGROUND OF THE INVENTION

1. Field of the Invention

The present invention pertains to the art of flexible, plastic, resealable storage bags and, more particularly, to a storage bag including an internal barrier.

2. Discussion of the Prior Art

Dual compartment sandwich bags including separate, sealable side-by-side compartments are known in the art as demonstrated by U.S. Design Pat. No. D563,241. Further, plastic storage bags which seal with the aid of a zipper are known as demonstrated by U.S. Patent Application Publication No. 2004/0066984. Regardless of these known bag arrangements, there still exists room for improvement within the storage bag arts. For example, there still exists the need for a simple plastic storage bag which is easy to use and provides for separating moist or wet components from dry components without the need for large, unnecessary packaging.

SUMMARY OF THE INVENTION

The present invention is directed to a flexible storage bag including an inner flexible barrier. More specifically, the flexible storage bag starts with interconnected first and second side wall portions that define an inner storage area having an opening. The flexible barrier is located within the inner storage area and preferably extends substantially the entire width of the inner storage area. The flexible barrier is connected to at least one of the respective bottom and opposing side edge sections of each of the first and second side wall portions such that the flexible barrier is retained within the inner storage area.

With this configuration, a user can select a first storage mode wherein the flexible barrier is positioned to one side of the storage area such that only a single storage section is available for storing products, or a second storage mode wherein the flexible barrier is positioned to divide the storage area into distinct first and second storage sections for separately storing one or more products. In this way, moist or wet food products such as vegetables or dip can be kept separate from dry products such as bread or chips.

An upper closure assembly is provided for selectively closing the opening of the flexible storage bag, and preferably includes a zipper having a loop extending therefrom to aid a user in zipping or unzipping the flexible storage bag and for hanging the flexible storage bag from a hook or the like. A top edge portion of the flexible barrier is provided within the flexible storage bag below a level of top side edge sections of each of the first and second side wall portions such that the flexible barrier member does not interfere with the function of the upper closure assembly. The flexible storage bag may also include a lower closure assembly for sealing the flexible barrier to one or both of the side wall portions. The flexible storage bag may also include other features such as offset tabs to aid in opening the bag and a graphical image puzzle for a user's entertainment and/or education.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
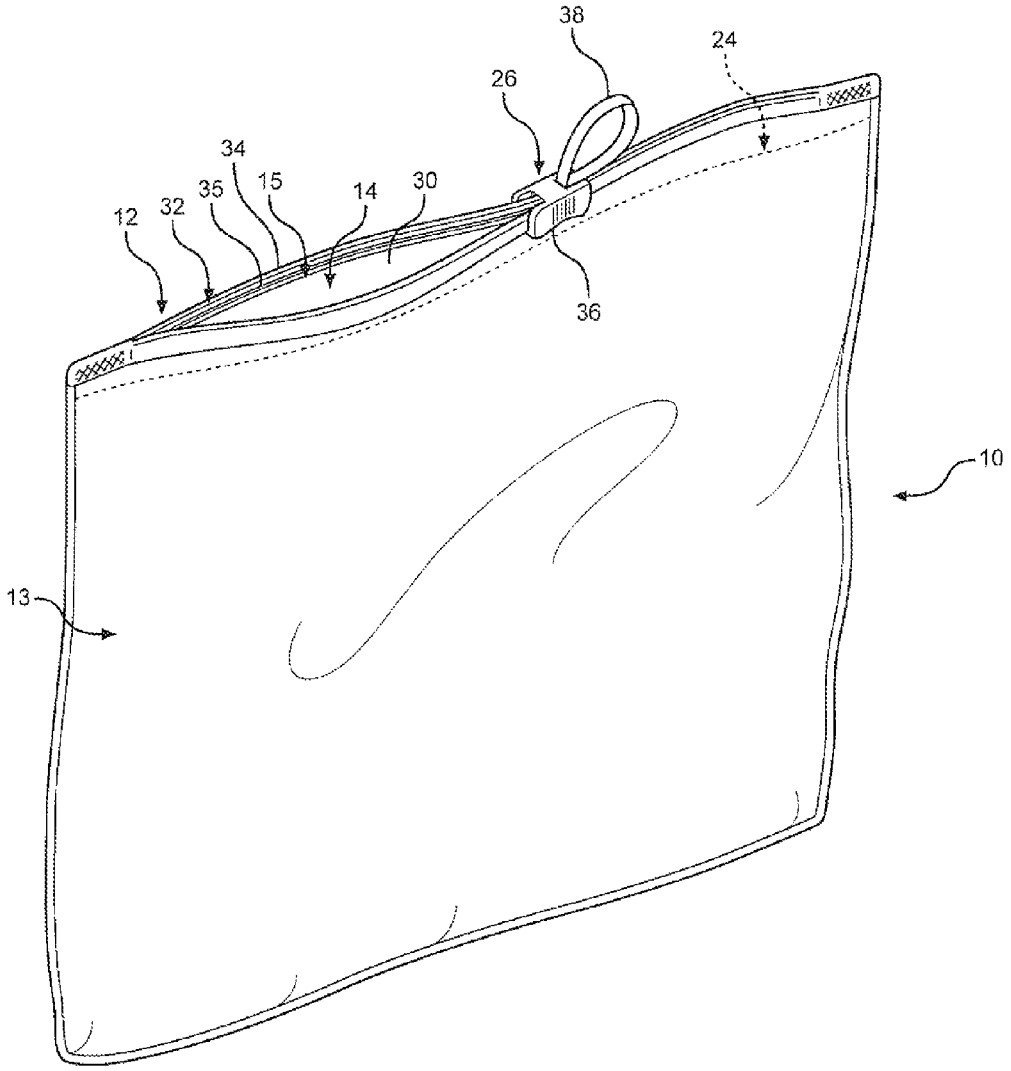
FIG. 1 perspective view of a flexible storage bag constructed in accordance with the present invention.
Figure 2:
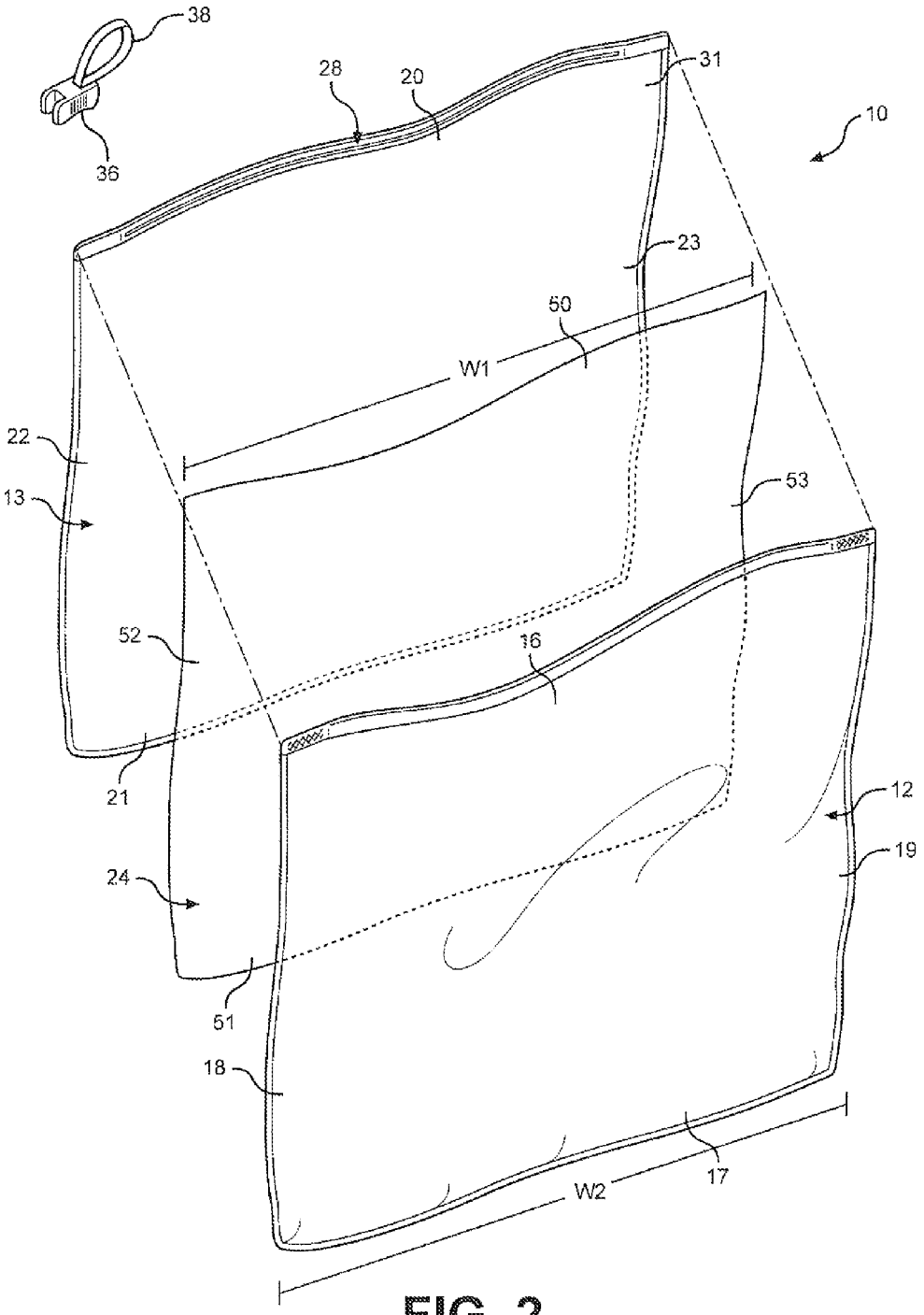
FIG. 2 is an exploded view of the flexible storage bag of FIG. 1.

With initial reference to FIG. 1, a flexible storage bag 10 includes first and second side wall portions 12 and 13 connected to form an inner storage area 14 having an opening 15. In one embodiment as shown in FIG. 2, first side wall portion 12 includes top, bottom and opposing side edge sections 16-19, while second side wall portion 13 includes top, bottom and opposing side edge sections 20-23. First and second side wall portions 12 and 13 are preferably made of a suitable plastic film material and are fused or otherwise interconnected at their respective bottom and opposing side edge sections 17-19 and 20-23 in a manner known in the art. Alternatively, first and second wall portions 12 and 13 may be constituted by a single folded sheet of flexible plastic material which is fused along side edge sections 18-19 and 21-23 in a manner also known in the art. At this point it is noted that materials suitable for use in the manufacture of plastic storage bags, as well as methods of forming plastic storage bags with a single storage compartment, are well known in the art and need not be detailed herein. Instead, the present invention is directed to a novel flexible storage bag 10 including an inner flexible barrier 24, as will be more specifically discussed below.

Figure 3A:
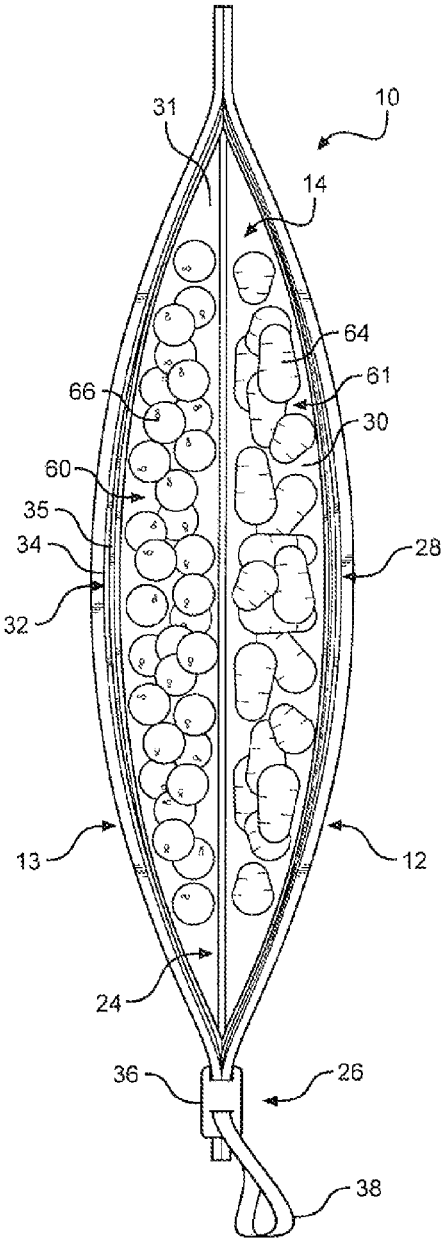
FIG. 3A is a top view of the flexible storage bag of FIG. 1, wherein both storage sections of the bag are utilized.
Figure 3B:
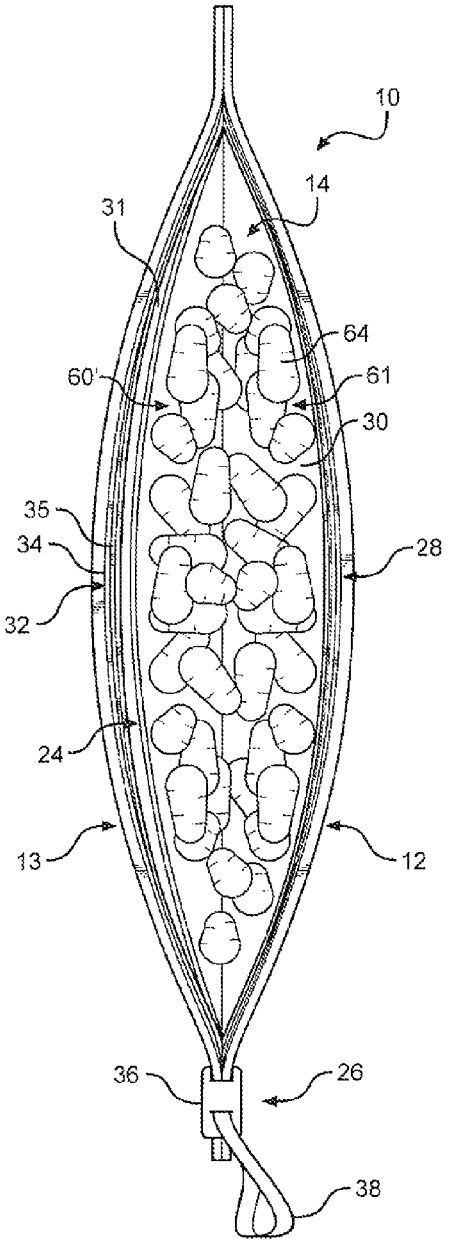
FIG. 3B is a top view of the flexible storage bag of FIG. 1, wherein only one storage section of the bag is utilized.
Figure 4A:
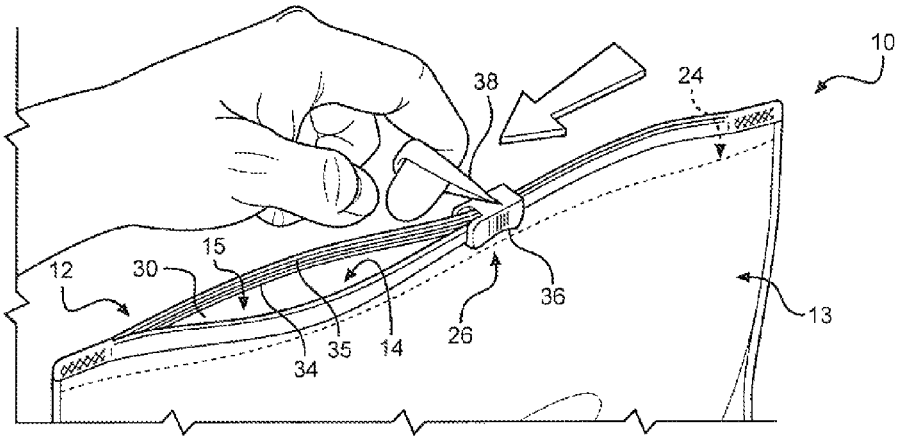
FIG. 4A shows the flexible storage bag of FIG. 1 being opened by a child.
Figure 4B:
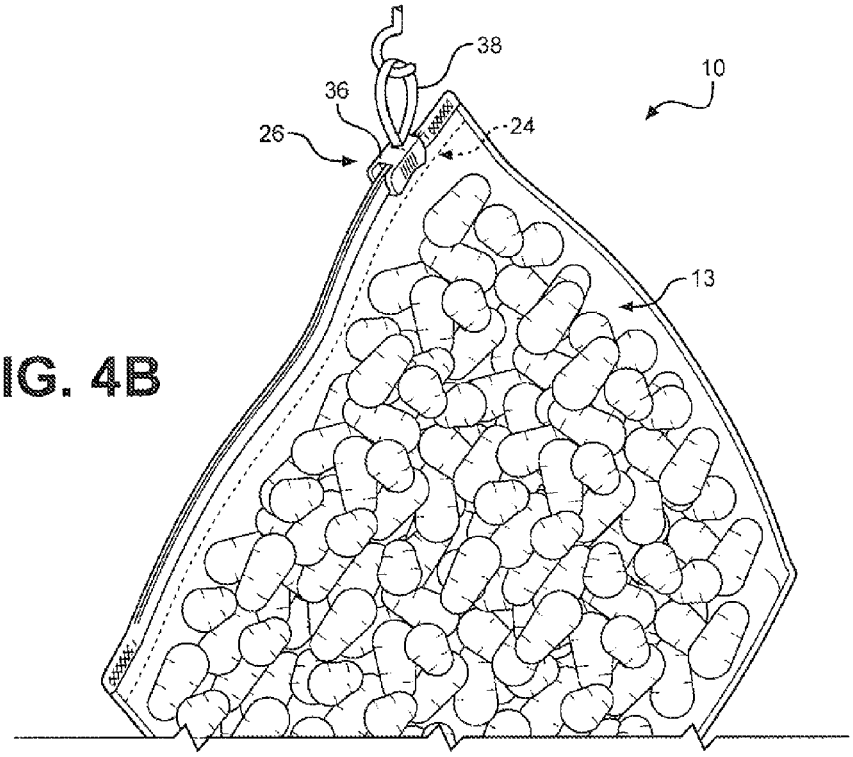
FIG. 4B shows the flexible storage bag of FIG. 1 hung from a hook in a storage position.

Flexible storage bag 10 further includes an upper closure assembly generally indicated at 26. As best shown in FIGS. 2 and 3A-3B, upper closure assembly 26 includes a male connection element 28 extending along an inner wall 30 of the first wall portion 12, and a female connection element 32 extending along an inner wall 31 of the second wall portion 13. In a manner known in the art, female connection element 32 includes first and second ridges indicated at 34 defining a channel 35 into which male connection element 28 is received to seal the top edge sections 16 and 20 of the first and second side wall portions 12 and 13 together, thereby sealing inner storage area 14. In a preferred embodiment, upper closure assembly 26 also include a zipper 36 slidably connected to the top edge sections 16 and 20 of the first and second side wall portions 12 and 13 and adapted to forcibly engage the male and female connection elements 28 and 32 to selectively zip or seal flexible storage bag 10 when slid in one direction and to unzip or unseal flexible storage bag 10 when slid in an opposing direction. As the manner in which a zipper element can cooperate with male and female connection elements to zip or unzip a storage bag is known in the art, it will not be detailed further herein. However, in accordance with an aspect of the present invention, zipper 36 preferably includes a loop 38 sized to allow the finger of a user, even a small child, to be inserted into the loop (see FIG. 4A) in order to pull zipper 36 to aid the user in zipping and unzipping flexible storage bag 10. Loop 38 can be integrally formed with zipper 36, or can be attached to zipper 36 via a hinge, or another connection arrangement such as tying a string or strap thereto. Additionally, loop 38 can advantageously function as a means for hanging flexible storage bag 10 from a peg, nail or the like (see FIG. 4B).

As best seen in FIG. 2, inner flexible barrier 24 includes top, bottom and opposing side edge portions 50-53. In a first embodiment, at least one of the bottom and opposing side edge portions 51-53 is connected to the corresponding bottom and opposing side edge sections 17-19 and 21-23 of side wall portions 12 and 13. For example, in one embodiment, bottom edge portion 51 is sealed to bottom edge sections 17 and 19 of respective first and second wall portions 12 and 13 to retain flexible barrier 24 within storage area 14, while maintaining top edge section 51 at a level below the level of upper closure assembly 26 so as to not interfere with the sealing of flexible storage bag 10. Flexible barrier 24 may have a width $W_1$ that is smaller than the width $W_2$ of side wall portions 12 and 13 such that opposing side edge portions 52 and 53 of flexible barrier 24 are not sealed to the flexible storage bag 10 during the manufacturing process, or width $W_1$ may be slightly larger than width $W_2$ to allow flexible barrier 24 to more easily be re-arranged within storage area 14. The flexible barrier 24 of this configuration can be advantageously used to selectively divide storage area 14 into first and second storage sections 60 and 61, as depicted in FIG. 3A, or may be flipped or pushed to one side of the flexible storage bag 10 such that flexible barrier 24 is pressed against the interior wall 30 or 31 of one of the first and second wall portions 12 and 13 to provide a single storage area 60' as depicted in FIG. 3B. That is, FIG. 3B depicts storage bag 10 being utilized as a single compartment bag for snacks 64, wherein the flexible barrier 24 is pushed to the side of the storage bag 10 before filling with snacks 64 such that only a single storage area 60' is utilized.

In a more preferred embodiment, each of the bottom and side edge portions 51-53 are sealed to the corresponding bottom and side edge sections 17-19 and 21-23 of respective first and second wall portions 12 and 13. Again, top edge portion 50 is preferably sized such that it is just below the male and female elements 28 and 34 of the upper closure assembly 26 so as not to interfere with the sealing of flexible storage bag 10, but provides a substantial barrier between first and second storage sections or zones 60 and 61. This embodiment, while not providing a total seal between the top of first and second storage zones 60 and 61, defines first and second storage zones 60 and 61 as separate containers. Thus, the first and second storage zones 60 and 61 can be advantageously utilized to separate moist or wet objects such as tomatoes, dip or blueberries indicated at 66 in FIG. 3A, from relatively dry objects such as snacks 64.

Advantageously, the present invention allows for a standard size storage bag to be utilized in a single storage mode wherein a single storage zone 60 is defined, or in a dual storage mode wherein contents within the storage area 14 can be separated by an inner flexible barrier 24 into first and second distinct storage zones 60 and 61. When used in the single storage section mode, storage bag 10 of the invention mimics the functionality of standard zip-locking plastic bags. However, the inclusion of inner flexible barrier 24 adds significantly more functionality, enabling various food items, which would normally need to be stored in two separate bags, to be located in separate compartments of storage bag 10. For instance, bread and meat for a sandwich can be separated from lettuce, tomato, pickles and the like, with the overall sandwich being readily assembled upon removing all the items from the single storage bag without the fear of soaking the bread. Certainly, an abundance of separable items may be stored, even non-food items, such as game parts, different types of fasteners, and even toiletries for airplane travel.

Figure 5A:
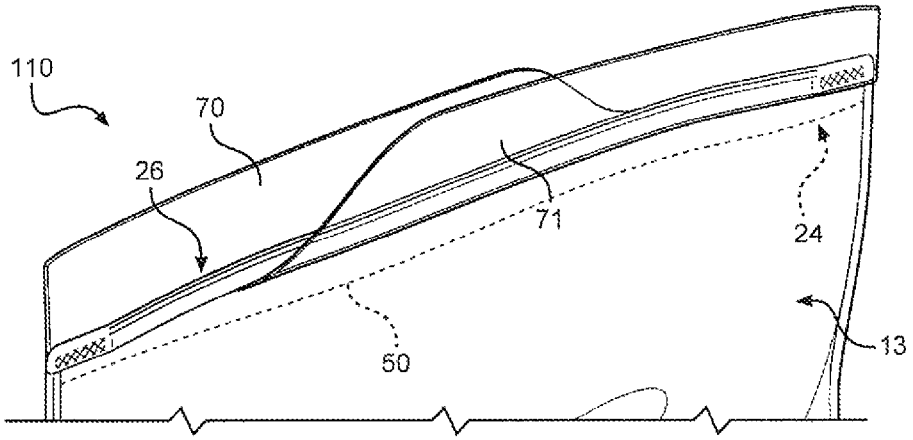
FIG. 5A shows a flexible storage bag of the present invention including offset tabs for opening the storage bag.
Figure 5B:
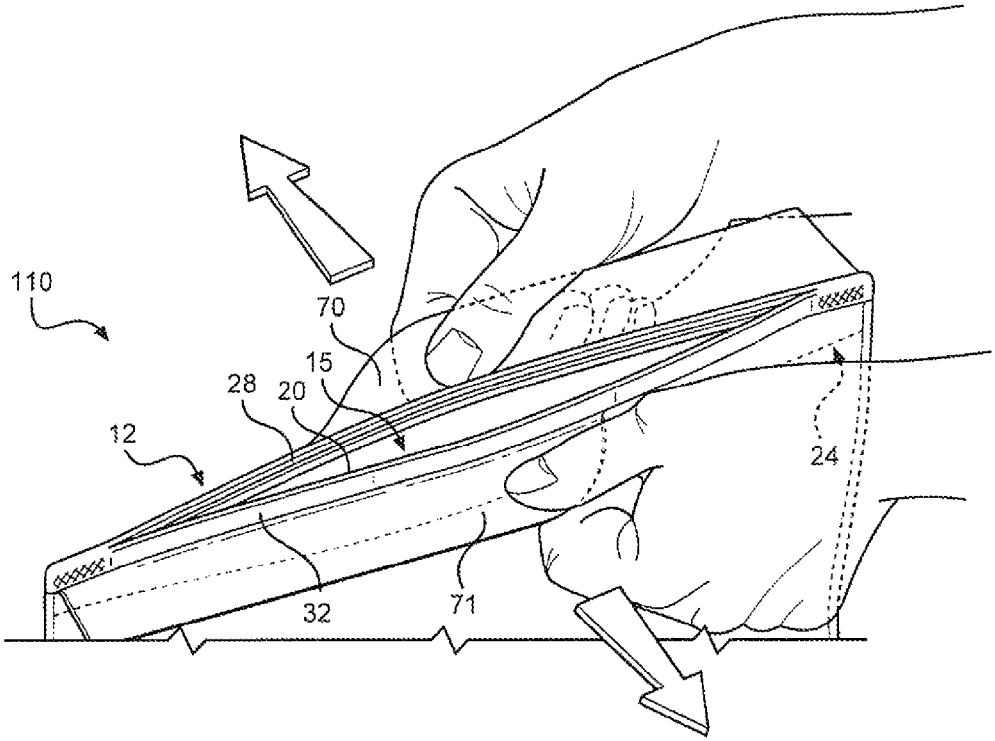
FIG. 5B shows the flexible storage bag of FIG. 5A opened.

With reference to FIGS. 5A and 5B, an alternative feature of the flexible storage bag of the present invention is shown at 110. In the embodiment shown, first and second tabs 70 and 71 extend from respective top edge sections 16 and 20 of the first and second side wall portions 12 and 13 above upper closure assembly 26. Preferably, first and second tabs 50 and 51 are at least partially offset from one another either horizontally, vertically, or both horizontally and vertically. With this configuration, a user can easily grasp the respective first and second tabs 70 and 71 in order to pull the first and second tabs 70 and 71 is opposite directions to unseal upper closure assembly 26, as depicted in FIG. 5*b*. Although only two tabs are shown, it should be understood that additional tabs could be added to respective top edge sections 16 and 20.

Figure 6A:
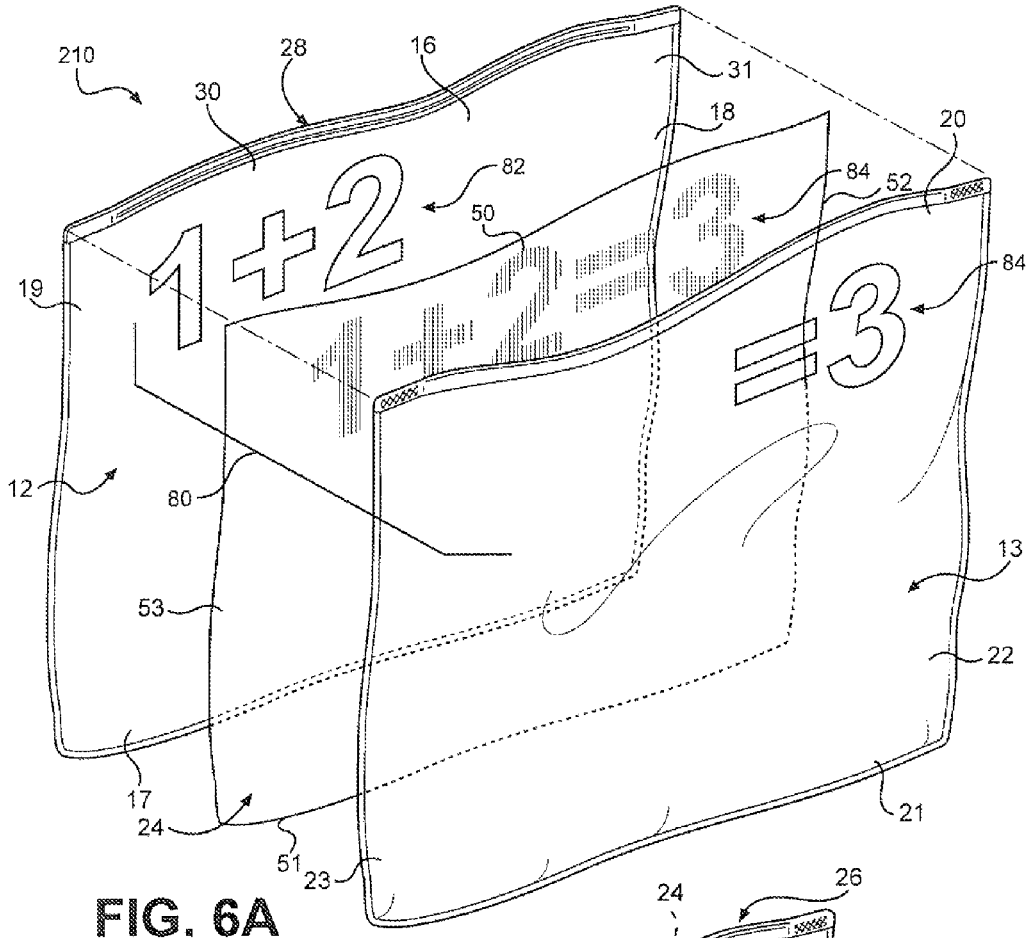
FIG. 6*a* is an exploded view of a flexible storage bag of the present invention including a graphical image puzzle constituted by separate graphical images.
Figure 6B:
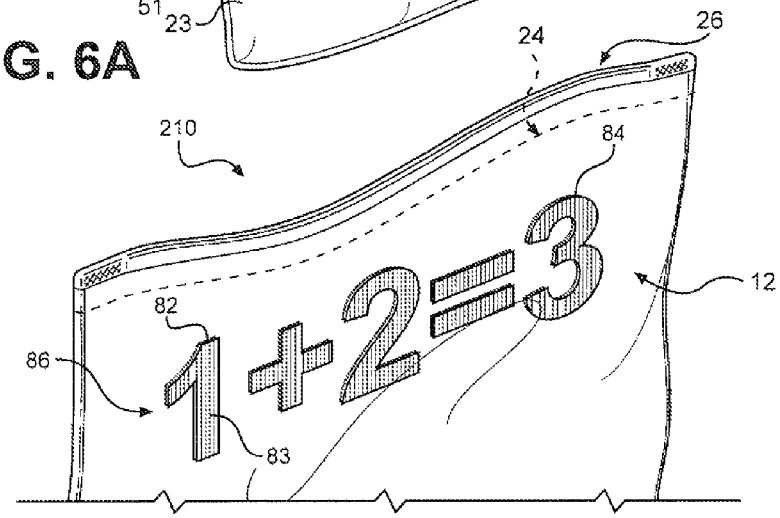
FIG. 6*b* is a front view of the flexible storage bag of FIG. 6*b*, showing a completed graphical image.

FIGS. 6A and 6B depict a further aspect of the present invention, wherein a flexible storage bag 210 includes a graphical image puzzle generally indicated at 80. Graphical image puzzle 80 comprises a plurality of graphical image pieces or elements indicated at 82, 83 and 84. In the embodiment shown, the first graphical image piece 82 is disposed on the first side wall portion 12, the second graphical image piece 83 is disposed on the flexible barrier 24, and the third graphical image piece 84 is disposed on the second side wall portion 13. Each graphical image piece 82, 83, 84 represents a portion of a completed graphical image indicated at 86 in FIG. 6B. More specifically, when the graphical image pieces 82, 83 and 84 are situated adjacent one another, as depicted in FIG. 6*b*, the graphical image pieces 82, 83 and 84 combine to form the completed graphical image 86, which is viewable by a user from outside of the flexible storage bag 210. In the embodiment shown, graphical image pieces 82, 83 and 84 combine to show a stylized mathematical formula 1+2=3. With this configuration, it should be understood that the first and second side wall portions 12, 13 and the flexible barrier 24 are transparent, while the graphical image pieces 82, 83 and 84 are at least partially opaque. It should also be understood that separating the graphical image pieces 82, 83 and 84 obscures the completed graphical image 86. For example, if a food item is placed within one of the first and second distinct storage zones 60 and 61 of flexible storage bag 210 between the graphical image piece 83 and one of the graphical image pieces 83 or 84, then a viewer would be unable to see all of the combined graphical image pieces 82, 83 and 84 such that the completed graphical image 86 would not be viewable or the view by a user would be obscured from outside of the flexible storage bag 210. Although shown with three graphical image pieces 82, 83 and 84, it should be understood that different combinations of graphical image pieces could be utilized with the present invention. For example, if graphical image piece 83 were removed, then graphical image pieces 82 and 84 could be combined to form a completed graphical image.

Figure 7:
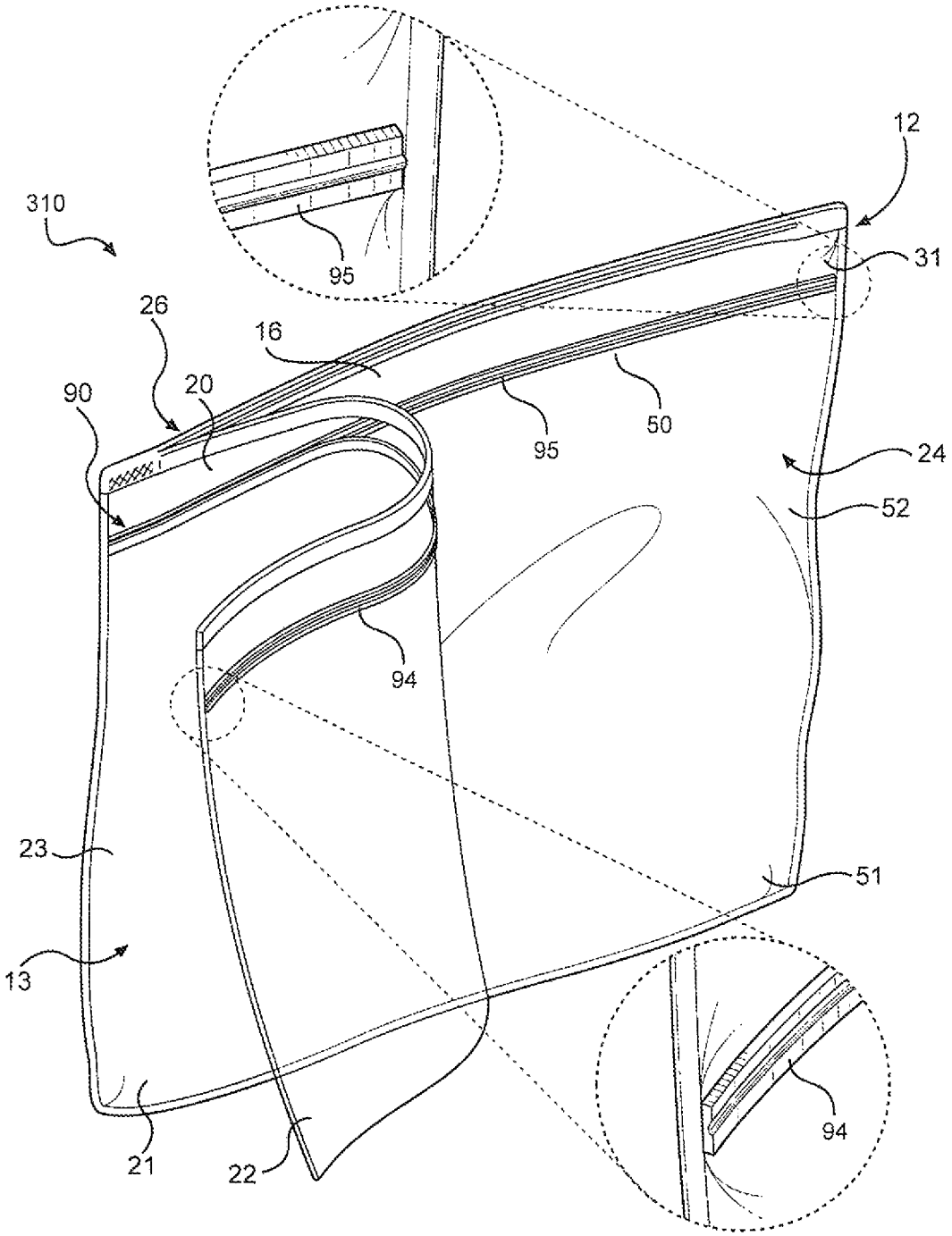
FIG. 7 is a perspective view of the flexible storage bag with one side wall shown partially torn back to better illustrate internal structure.

FIG. 7 depicts another aspect of the present invention with the second side wall portion 13 shown pulled back to expose details of a lower closure assembly 90 within a flexible storage bag 310. Preferably, flexible storage bag 310 includes an upper closure assembly 26 identical to the one described above with respect to FIG. 2. Additionally, lower closure assembly 90 is provided below upper closure assembly 26 to selectively seal one of the storage zones 60 and 61 of flexible storage bag 310. Preferably, lower closure assembly 90 is constituted by male and female connection elements 94 and 95 that selectively zip to seal one of the storage zones 60 and 61 of flexible storage bag 310. More specifically, male element 94 is located on one of the first and second side wall portions 12, 13 or on flexible barrier 24, and female element 95 is located opposite male element 84 on another of the first and second side wall portions 12, 13 or flexible barrier 24 such that male and female elements 94 and 95 can be selectively engaged to seal one of the first and second storage zones 60 and 61 in a manner directly corresponding to upper closure assembly 26. Although not depicted, it should be understood that a second lower closure assembly could be provided identical in construction to the first lower closure assembly, such that the first lower closure assembly selectively seals first storage zone 60, the second lower closure assembly selectively seals the second storage zone 61 and upper closure assembly 26 selectively seals opening 15.

Although described with reference to preferred embodiments of the invention, it should be readily understood that various changes and/or modifications can be made to the invention without departing from the spirit thereof. For instance, although the inner flexible barrier 24 and first and second wall portions 12 and 13 are shown as separate plastic sheets, it should be understood that a single plastic sheet may be folded multiple times and welded together to form the first and second wall portions 12 and 13 and the inner flexible barrier 24. Additionally, it should be clear that all of the various features and aspects discussed above can be combined in different combinations to form flexible storage bags with multiple features, such a graphical image puzzle 80 and upper and lower closure assemblies 26 and 90. In general, the invention is only intended to be limited by the scope of the following claims.

I claim:

1. A flexible storage bag comprising:

first and second, outermost side wall portions each made from a single folded sheet of flexible material and including top, bottom and opposing side edge sections, wherein a fold of the sheet establishes the bottom and the opposing side edge sections of the first side wall portion are interconnected to the opposing side edge sections of the second side wall portion to establish an inner storage area having an opening;

a first closure assembly located externally on top edge sections of the first and second side wall portions and adapted to selectively open and close the opening of the flexible storage bag, wherein the first closure assembly includes a male element located on the top edge section of the first side wall portion, and a female element located on the top edge section of the second side wall portion which mates with the male element to seal the top edge sections of the first and second side wall portions together and wherein the first closure assembly further includes a zipper slidably connected to the top edge sections of the first and second side wall portions and engaging the male and female elements to selectively zip and unzip the flexible storage bag, the zipper including a loop connected thereto adapted to be engaged by a finger of a user to aid a user in sliding the zipper relative to the top edge sections of the flexible storage bag;

a flexible barrier, including top, bottom and opposing side edge portions, within the inner storage area, the flexible barrier extending at least substantially an entire width of the inner storage area with a top side edge portion of the flexible barrier being below a level of the top side edge sections of the first and second side wall portions such that the flexible barrier does not interfere with the function of the first closure assembly, and at least one of the bottom and opposing side edge portions of the flexible barrier is connected to at least one of the fold of the bottom and the respective opposing side edge sections of the first and second side wall portions such that the flexible barrier is retained within the inner storage area wherein the flexible barrier is configured to be selectively positioned within the inner storage area between a single storage mode and a dual storage mode, wherein when the flexible barrier is positioned directly adjacent the first side wall portion a single storage zone is defined between the flexible barrier and the second side wall portion in the single storage mode, and when the flexible barrier is positioned between the first and second side wall portions a first storage zone is defined between the flexible barrier and the first side wall portion and a second storage zone is defined between the flexible barrier and the second side wall portion in the dual storage mode; and a graphical image puzzle including a first graphical image disposed on the first side wall portion and a second graphical image disposed on one of the second side wall portion and the flexible barrier wherein the first and second graphical images combine to form a completed graphical image that is viewable by a user from outside the flexible storage bag when the first graphical image is situated adjacent the second graphical image, and the completed graphical image is obscured when the first graphical image is not situated adjacent the second graphical image, such as when a food product is located between the first and second graphical images within the inner storage area and wherein the second graphical image is disposed on the flexible barrier and the graphical image puzzle further includes a third graphical image disposed on the second side wall portion such that the first, second and third graphical images combine to form the completed graphical image that is viewable by a user from outside the flexible storage bag when the first, second and third graphical images are adjacent one another, and the completed graphical image is obscured when the first, second and third graphical images are not situated adjacent one another, such as when a food product is located between at least one of the first, second and third graphical images within the inner storage area.

2. The flexible storage bag of claim 1, further comprising:

a first tab extending from a top end of the first side wall portion; and a second tab extending from a top end of the second side wall portion, wherein the first and second tabs are offset from one another such that the first and second tabs are positioned to be grasped by a user and pulled apart in opposite directions in order to unseal the top edge sections of the first and second side wall portions.

3. The flexible storage bag of claim 1, wherein the bottom and opposing side edge portions of the flexible barrier are connected to the fold of the bottom and respective opposing side edge sections of each of the first and second side wall portions and selectively divide the inner storage area into first and second separate and distinct storage zones.

4. The flexible storage bag of claim 3, further comprising:

a second closure assembly positioned below the first closure assembly and within the flexible storage bag, with the second closure assembly being adapted to selectively seal one of the first and second storage zones.

5. The flexible storage bag of claim 4 wherein the second closure assembly is adapted to seal the first storage zone and said flexible storage bag further comprises:

a third closure assembly positioned below the first closure assembly within the flexible storage bag, said third closure assembly being adapted to seal the second storage zone.

* * * * *